United States Patent [19]

Pittman

[11] 4,428,640

[45] Jan. 31, 1984

[54] PROTECTIVE MEANS FOR MULTIPLE PIN CONNECTORS

[75] Inventor: Robert B. Pittman, River Edge, N.J.

[73] Assignee: Industrial Electronic Hardware, New York, N.Y.

[21] Appl. No.: 334,134

[22] Filed: Dec. 24, 1981

[51] Int. Cl.[3] ..... H01R 13/516

[52] U.S. Cl. ..... 339/176 M; 339/17 LC; 339/210 M

[58] Field of Search ..... 339/65, 66 M, 17 LC, 339/176 M, 206 R, 210 R, 210 M

[56] References Cited

U.S. PATENT DOCUMENTS

| | | | |
|---|---|---|---|
| 3,208,026 | 9/1965 | Ruehlemann | 339/17 LC |
| 3,230,493 | 1/1966 | Jensen et al. | 339/17 LC |
| 3,264,599 | 8/1966 | Kinkaid | 339/17 LC |
| 3,384,864 | 5/1968 | Schwartz | 339/17 LC |
| 3,409,862 | 11/1968 | Lynch et al. | 339/17 LC |
| 3,864,010 | 2/1975 | Wasserlein, Jr. | 339/210 M |
| 4,072,402 | 2/1978 | Butler | 339/136 M |
| 4,134,632 | 1/1979 | Lindberg et al. | 339/17 LC |
| 4,264,114 | 4/1981 | Chandler | 339/17 LC |
| 4,366,527 | 12/1982 | Bell | 339/17 LC |

FOREIGN PATENT DOCUMENTS

| | | | |
|---|---|---|---|
| 728296 | 2/1966 | Canada | 339/17 LC |
| 1232014 | 10/1960 | France | 339/17 LC |
| 2295586 | 7/1976 | France | 339/17 LC |
| 2026790 | 2/1980 | United Kingdom | 339/17 LC |

OTHER PUBLICATIONS

Circon Advertisement, Nov. 1, 1954.

*Primary Examiner*—John McQuade
*Assistant Examiner*—Gary F. Paumen
*Attorney, Agent, or Firm*—James & Franklin

[57] ABSTRACT

Either one or two separate skirts may be used as an accessory with an electrical connector part designed to be mounted on a circuit board by a screw or the like. The skirts protect the pins extending from the connector part and facilitate mounting of the connector part to the board. The skirt, designed for mounting on the far side of the connector part, has protruding bushings situated to be received in openings in the connector part and to engage the screws extending from the board such that the skirt and connector part can be mounted to the board as a unit. The second skirt, designed to be interposed between the connector part and the board, may be utilized if pin protection from both sides is required. In this case, both skirts and the connector part are mounted as a unit on the board.

6 Claims, 4 Drawing Figures

PROTECTIVE MEANS FOR MULTIPLE PIN CONNECTORS

The present invention relates to electrical connectors and, more particularly, to separate protective means designed for use as accessories with such connectors to provide protection for the extending pins thereof and to facilitate the mounting of same on a circuit board.

An electrical connector is a device which is used to provide electrical connection between circuit boards, cables or the like. Many different types of electrical connectors are known and the particular structure of each depends upon the application for which same is intended.

Electrical connectors designed for making connection to a circuit board normally comprise two separate parts, each including a block of insulating material such as plastic. In the male part of the connector, a first set of electrically isolated pins extend from one surface. These pins are utilized to individually engage different contacts on a circuit board or the like. A second set of electrically isolated pins extend from another surface of the block for engagement with the pin receiving contacts on the female part of the connector. Within the block of the male part, the pins in one set are respectively electrically connected to the corresponding pins in the other set. The female part of the connector has recessed contacts on one surface thereof. Each contact is designed to engage a different one of the protruding pins on the male part, when the male part is plugged into the female part. The contacts on the female part may, in turn, be connected to a multi-strand cable or to another circuit board, or the like.

Multiple pin connectors designed for use with a circuit board are often of the "right angle" type. In such connectors, one connector part is mounted adjacent a surface of a circuit board with the pins extending from that surface in electrical contact with the contacts on the circuit board. The pins provided to make contact with the female part extend perpendicular to the circuit board engaging pins and, thus, in a direction parallel to the circuit board. This structure facilitates connection with a female part mounted on another circuit board which may be situated in the same plane as the circuit board to which the male part is mounted and reduces the space necessary if a cable connection is required.

Once mounted on the circuit board, but prior to engagement with the female part, the protruding pins on the male part are exposed. The exposed pins may become dislocated, bent, or damaged, preventing the proper mating with the female part, if same inadvertently come into physical contact with external objects during handling or shipping. It is therefore desirable to protect the protruding pins of the male part of the connector from damage in this fashion.

In the past, protection of the protruding pins on the male part of the connector has been achieved in two different ways. In some instances, it is possible to inwardly space the connector part along the surface of the circuit board, a short distance from the edge thereof, such that the protruding pins do not extend beyond the edge of the circuit board. In this way, a portion of the circuit board itself is utilized to protect the pins from one side. However, due to crowding of the circuit board or other design considerations, mounting of the male part of the connector in this manner may not be possible or desirable.

In instances where the recessing of the male part of the connector with respect to the edge of the circuit board is impossible or undesirable, the male part of the connector may itself be provided with one or two integral skirts extending from the surface of the block, at one or both sides of the pins, so as to protect the pins from physical damage. However, the use of integral protective skirts creates a problem because connector parts of different structures must be provided for different applications. Specifically, where protection from both sides is required, the connector part must be provided with integral skirts on both sides of the pins; where protection from only one side is required, because it is possible to recess the connector part relative to the edge of the circuit board, a connector having only a single protective skirt is required; and in instances where no protection is required or desired, a connector part having no protective skirts must be utilized.

Many different basic connector parts, of different sizes, shapes, numbers of pins and pin materials are used. Providing three versions of each model creates substantial manufacturing and inventory problems. The problem of supplying three different versions of each model connector part is further compounded because, in many instances, the basic connector part, that is, the connector part without protective skirts, is designed to the specifications of and has been approved by various government agencies and/or industrial customers. When variations of the basic part are supplied, having either one or two integral skirts, separate approval for each version must be obtained.

In order to overcome the problems associated with manufacturing, obtaining approval for, inventorying and supplying multiple versions of each connector model, I have devised a system whereby either one or two protective skirts, fabricated and supplied separately from the connector part itself, may be used in conjunction with the basic connector part to provide protection from one side or both sides, at the user's option. In this manner, only the basic connector part need be manufactured, inventoried and supplied. The same basic male part of the connector is always utilized by the customer and, thus, only a single approval is required. Separately manufactured protective skirts are also supplied upon order. The user may then use the connector as is or add one or two skirts thereto, at his option, solving the supply, inventory and approval problems.

The male part of the connector is designed for physical mounting on a circuit board with screws extending from the circuit board. The block of the connector part is provided with openings through which the screws extend. On the surface of the block of the connector designed to face away from the circuit board, the openings are enlarged to receive a nut. The nut is internally threaded so as to mate with the external threads of the screw such that the male part of the connector can be secured to the surface of the circuit board.

Since the male part of the connector normally contains a large number of pins thereon, each of which must be electrically isolated from all of the other pins, the block of the male part of the connector is often elongated, thus requiring two or more screws positioned along the length thereof to properly secure the block to the circuit board. A plurality of screws, spaced along and extending from the circuit board, are used, each screw being designed to mate with a nut which must be individually positioned and affixed thereto. Thus, the mounting of the male part of the connector on the circuit board requires a relatively large amount of labor and is time consuming.

The mounting problem would normally be aggravated if separate protective skirts are mounted on the circuit board along with the male part of the connector. This is because the male part of the connector and the individual protective skirts must be properly aligned with and held in place relative to each other and with respect to the circuit board as each nut is positioned and each screw tightened.

Each skirt is provided with a body portion designed to be situated adjacent a surface of the block of the connector part with a protective portion extending therefrom in a direction parallel to the extension of the exposed pins from the connector. The body portion must be provided with openings situated to be aligned with the openings in the block of the connector to receive the screws extending from the circuit board and through the openings in the connector block.

In this instance, it is desirable to make the protective skirts as thin as possible such that the overall dimensions of the unit, including the connector part and the protective skirts, closely approximates the dimensions of the connector part alone. Because the protective skirts are so thin, it is not possible to recess the nuts used to engage the screws extending from the circuit board within the protective skirt which is mounted on the surface of the connector part opposite to that adjacent to the surface of the circuit board. Thus, the nuts protrude from the surface of the connector-skirt unit. This result is undesirable because of space considerations and because the protruding nuts may come in contact with external objects such as adjacent circuit boards, causing physical or electrical damage to delicate circuit board components.

It is, therefore, a prime object of the present invention to provide separate protective means for multiple pin connectors which may be utilized as accessories with the basic connector part in order to provide protection from one or both sides of the connector, at the user's option.

It is another object of the present invention to provide protective means for multiple pin connectors which will eliminate the problems associated with manufacturing, obtaining approval for, inventorying and supplying multiple versions of the same basic connector part.

It is another object of the present invention to provide protective means for multiple pin connectors wherein the assembly and mounting of the connector with either one or two protective skirts to a circuit board is facilitated.

It is another object of the present invention to provide protective means for multiple pin connectors wherein the connector part and protective skirt combination is mounted on the circuit board in a manner which eliminates the protrusion of any nuts or similar mounting devices.

It is another object of the present invention to provide protective means for multiple pin connectors which facilitate the proper alignment between the male and female connector parts.

In accordance with the present invention, pin protective means are provided for use with an electrical connector of the type designed to be mounted on a circuit board by a mounting device extending from the board. The connector comprises a part carrying a pin which extends in a given direction. The part also has an opening therein adapted to receive the mounting device extending from the circuit board. The protective means comprises a body part with a protective part extending therefrom. The body part includes means for engaging the mounting device. The connector part is adapted to be positioned between the body part of the protective means and the circuit board with the protective part extending in a direction generally parallel to the given direction. The device engaging means is situated to be aligned with the opening in the connector part to engage the mounting device and secure the connector part and the protective means, as a unitt, to the circuit board.

The protective means further comprises a second body part having a second protective part extending therefrom. The second body part has an opening therein adapted to align with the opening in the connector part when same is positioned between the connector part and the circuit board, with the second protective part extending in a direction generally parallel to the given direction. This configuration permits the mounting device to extend through the second body part such that the first and second body parts and the connector part are secured to the circuit board as a unit.

The device engaging means preferably at least partially extends from the surface of the body part and the opening in the connector part is preferably provided with a portion large enough to at least partially receive the extended portion of the device engaging means therein. Preferably, the enlarged portion of the opening is designed such that the entire extension of the device engaging means is received therein. In this manner, the surface of the body part can be situated closely adjacent to the surface of the connector part.

Preferably, the extending protective parts of the protective means each have an inwardly facing surface which is shaped to facilitate alignment between the male and female connector parts as same are mated.

To these objects and to those such other objects which may hereinafter appear, the present invention relates to protective skirts for use with multiple pin connectors, as described in the following specification and recited in the annexed claims, taken together with the accompanying drawings, wherein like numerals refer to like parts and in which:

Figure 1:
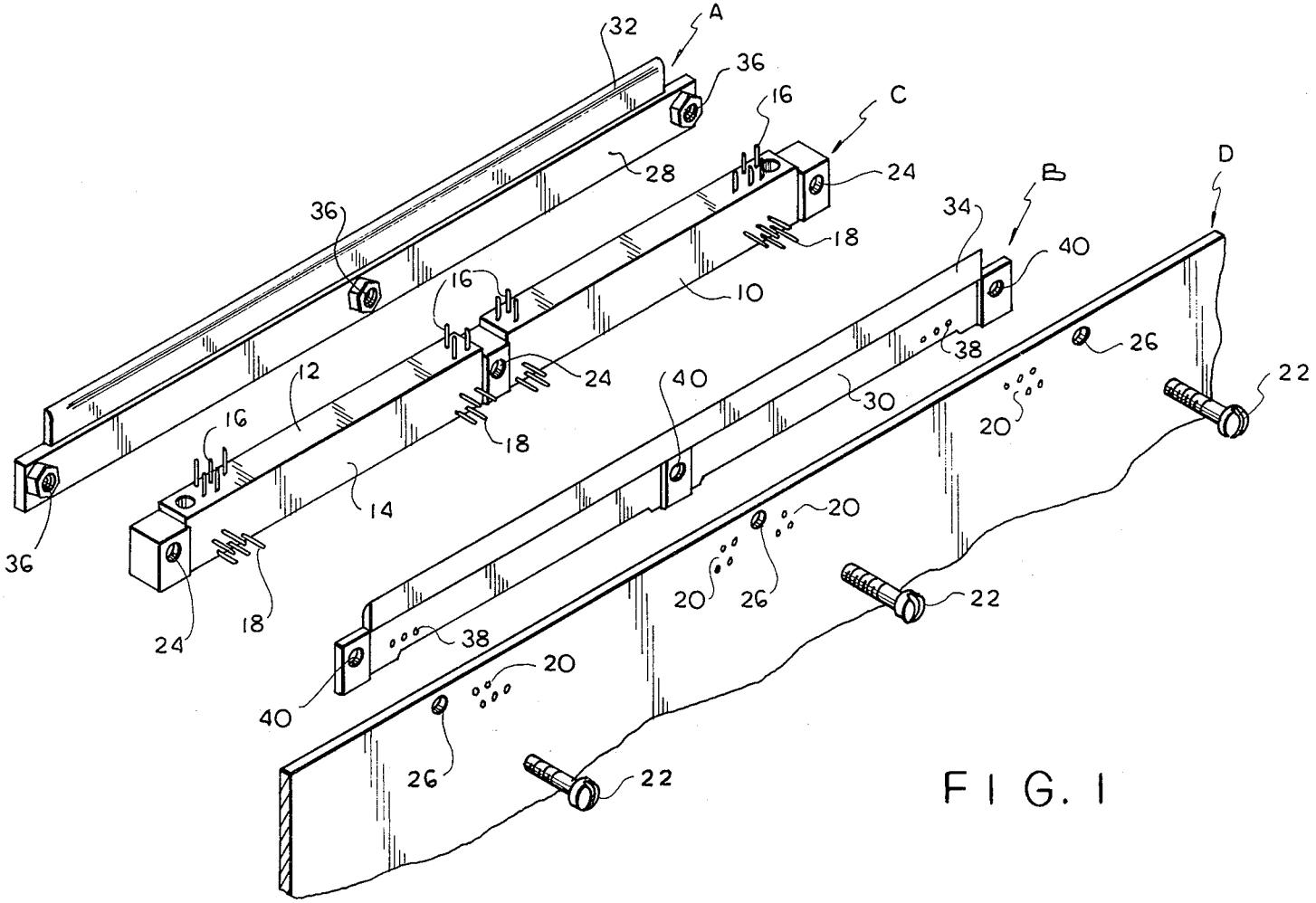
FIG. 1 is an exploded isometric view illustrating the structure of the protective means of the present invention and the manner in which same may be mounted as a unit with a multi-pin electrical connector part on a circuit board.

As seen in FIG. 1, the present invention relates to protective means, generally designated A and B, respectively, designed for use as accessories with the male part of a conventional "right angle" multi-pin electrical connector, generally designated C, which is designed for mounting to the surface of a circuit board or the like, generally designated D. Protective means B may be utilized between connector C and circuit board D, or not, depending upon whether protection of the pins is required from both sides or only a single side.

Electrical connector part C comprises an elongated body part 10 having a generally rectangular cross-section and made of insulating material such as molded plastic or the like. Part 10 has two adjacent surfaces 12, 14 from which separate sets of electrically isolated pins 16 and 18 respectively extend. Each of the pins in pin set 16 is electrically connected, through part 10, to the corresponding pin in set 18. The pins in set 16 extend from connector part C in a direction which is generally perpendicular to the direction of extension of the pins in set 18 and, hence, the connector illustrated is commonly referred to as a "right angle" connector.

Pins 18 are positioned on surface 14 of connector part C so as to align and be inserted through a plurality of openings 20 situated on circuit board D. Within openings 20, pins 18 are electrically engaged and connected to the various circuits (not shown) on the circuit board D.

Connector part C is designed to be physically mounted on the surface of circuit board D by means of a plurality of mounting devices such as screws 22. Part 10 of connector part C is provided with openings 24 which are situated to align with the openings 26 in circuit board D when pins 18 are received within openings 20 on circuit board D. Openings 24 extend through the entire part 10 of connector part C and, preferably, have an inner diameter which is roughly equivalent to the inner diameter of openings 26 which, in turn, is slightly larger than the outer diameter of the threaded portion of the screws 22. A portion of each of the openings 24, adjacent the side of body part 10 of connector part C which faces away from circuit board D, is enlarged so as to receive a nut therein.

When the connector part C is mounted to circuit board D without protective means A and B, the pins 18 are inserted into openings 20 such that openings 24 in the connector align with openings 26 in the circuit board. Each of the screws 22 is then inserted within one of the aligned sets of openings 24 and 26. A separate nut is situated within the enlarged portion of each opening 24 and each of the screws 22 is rotated, in turn, such that the external threaded part thereof is physically engaged by the internally threaded portion of the aligned screw 22.

Each of the protective means A and B is provided with a body portion 28, 30, respectively, from which a protective portion 32, 34, respectively, extends. When body portions 28 and 30 are mounted on circuit board D, along with connector part C, protective portions 32 and 34 thereof will extend in a direction which is generally parallel to the direction in which pins 16 extend and to approximately the same extent as pins 16, such that pins 16 are protected from both sides.

Body parts 28 and 30 of protective means A and B are elongated to approximately the same extent as is connector part C and have generally rectangular cross-sections. Protective parts 32 and 34 are elongated to a somewhat shorter extent, but are sufficiently elongated to protect all of the pins 16. Each of the protective parts 32 and 34 is shown as having a generally curved or tapered inner surface and a planar outer surface, such that the curved inner surfaces, designed to face pins 16, act to facilitate alignment of the male part with the corresponding female part (not shown) during mating.

The surface of body part 28 of protective means A, which is designed to be mounted adjacent the surface of connector part C, is provided with a plurality of protruding mounting means engaging means 36, shown as internally threaded bushings. Each of the bushings 36 is aligned with and designed to be received within the enlarged portion of the corresponding opening 24 within body part 10 of connector part C.

Protective means A and connector part C are mounted as a unit to circuit board D by aligning protective means A with connector part C such that bushings 36 are received within the enlarged portions of the respective openings 24 in part 10. Part 10 is then moved to a position adjacent the surface of circuit board D with pins 18 extending therefrom received in the appropriate corresponding openings 20 on the circuit board. Screws 22 are then inserted within openings 26 and 24 so as to engage the bushings 36, and tightened.

It should be noted that mounting bushings 36 on protective means A substantially reduces the amount of labor and time required for the mounting procedure because once protective means A is properly aligned with respect to connector part C, all of the bushings 36 are properly aligned with screws 22 and manipulation of separate nuts while maintaining connector part C in proper alignment with circuit board D is eliminated.

If protection of pins 16 is required from both sides, a second protective means B may be interposed between connector part C and circuit board D prior to mounting to circuit board D. Part 30 of protective means B is provided with a set of openings 38, aligned with pins 18 and slightly larger than the outer diameter thereof such that pins 18 may extend through protective means B and into openings 20 on circuit board D. In addition, part 30 of protective means B is provided with a plurality of openings 40 situated to be aligned with openings 26 in circuit board D and openings 24 in connector part C, and having an inner diameter approximately equal to the inner diameter of openings 24 and 26.

When mounting protective means A and B and connector part C as a unit to circuit board D, protective means B is moved into a position adjacent surface 14 of connector part C such that pins 18 protrude through openings 38 and protective means A is moved into a position adjacent the surface of connector C, opposite surface 14, such that bushings 36 are received within the enlarged portions of the respective openings 24. This unit is then moved adjacent the surface of circuit board D such that the pins 18 are received within openings 20 and screws 22 may be inserted within the aligned openings and rotated to engage the respective bushings 36.

Figure 2:
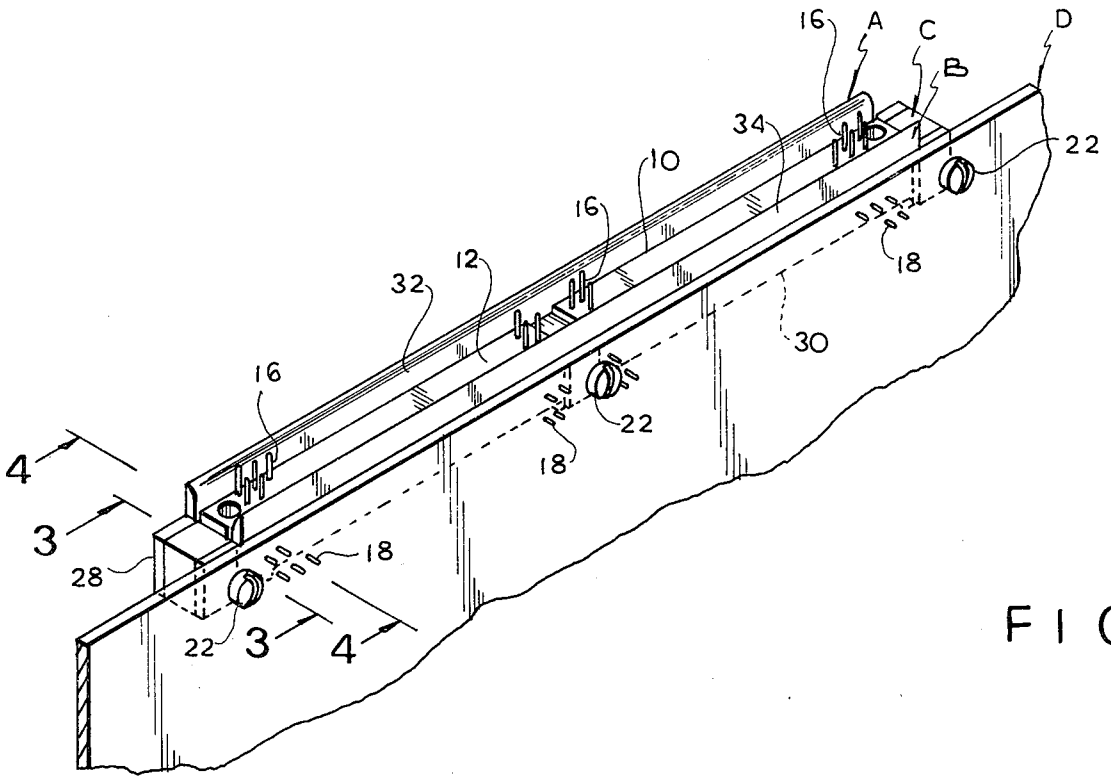
FIG. 2 is an isometric view of the protective means of the present invention as same appears when mounted as a unit with a multi-pin electrical connector part to the circuit board.
Figure 3:
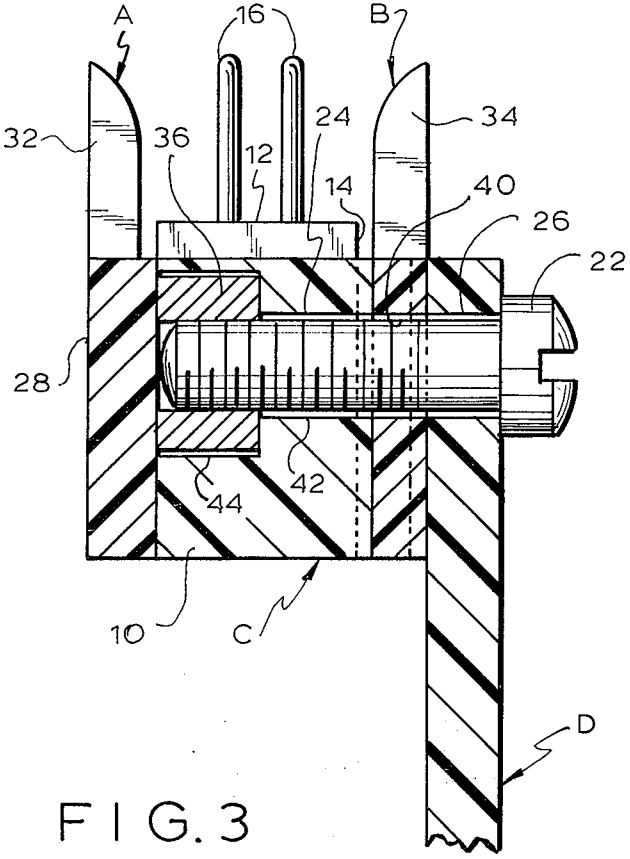
FIG. 3 is an enlarged cross-sectional view taken along line 3—3 of FIG. 2.

FIG. 2 shows the connector/protective means combination as it would appear after being mounted on a circuit board D. FIG. 3 illustrates the internal shape of opening 24 in part 10 of connector part C and, particularly, the manner in which bushing 36 is received therein.

As is readily apparent from FIG. 3, opening 24 within part 10 of connector part C has a first portion 42, having an inner diameter which is slightly larger than the outer diameter of the threaded portion of screw 22 and which extends from surface 14 of part 10 approximately half way through the part. The enlarged portion 44 of opening 24 extends from the surface of the connector opposite the surface 14 to portion 42 of opening 24, preferably to a depth at least as large as the extent to which bushings 36 extend from part 28 of protective means A. Thus, bushing 36 is preferably received in its entirety within enlarged portion 44 of opening 24.

The shape of enlarged portion 44 of opening 24 is not critical as long as same is large enough to accommodate the bushing 36. It is not necessary that the internal shape of enlarged portion 44 coincide with the external shape of bushing 36 because it is not necessary that enlarged portion 44 prevent the rotation of bushing 36 when screw 22 is rotated because bushing 36 is fixedly mounted to the surface of part 28 of protective means A.

Figure 4:
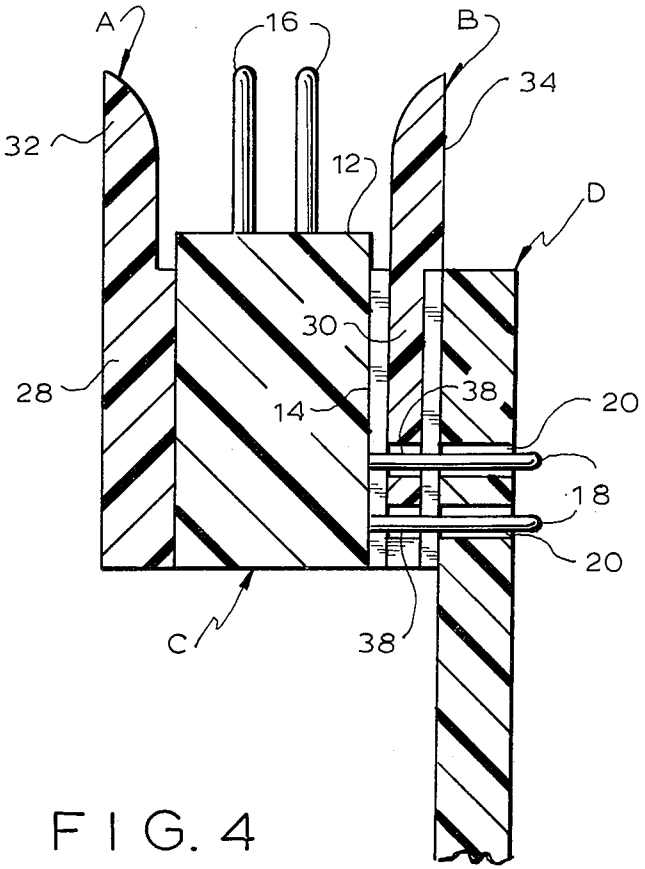
FIG. 4 is an enlarged cross-sectional view taken along line 4—4 of FIG. 2.

FIG. 4 illustrates the manner in which pins 18 extend through openings 38 in protective means B and thereafter through openings 20 in circuit board D, when protective means B is interposed between connector C and circuit board D.

It should now be appreciated that the present invention relates to protective means for multiple pin electrical connector parts. The means are designed to protect the pins extending from the connector part and to facilitate the mounting of the connector part to the board. A first protective means is provided with protruding bushings designed to be received within enlarged portions of the openings in the connector part and to engage screws extending from the circuit board such that the first means and the connector can be mounted to the circuit board as a unit. A second protective means, designed to be interposed between the connector and the circuit board, may be utilized if protection from both sides of the connector part is required. In that case, both protective means and the connector part are mounted as a unit on the board.

Accordingly, the connector may be provided without protective means or with one or both protective means, as is required for a particular application. In this manner, the user has complete freedom to achieve the protection required for a particular application and the necessity for the manufacture, inventorying, supply and approval of multiple versions of the same basic connector part are eliminated.

While only a single preferred embodiment of the present invention has been disclosed herein for purposes of illustration, it is obvious that many variations and modifications could be made thereto. It is intended to cover all of the variations and modifications which fall within the scope of the present invention, as defined by the following claims.

I claim:

1. Pin protection means for use with an electrical connector of the type having a body with first and second adjacent sides, the first side being adapted to be mounted proximate the surface of a circuit board by a mounting device extending from the board through an opening in the body and into a recess in the body aligned with the opening, the recess being adapted to receive mounting device engaging means therein, the connector body having a first set of pins extending from said first side and a second set of pins extending from the second side, the first set of pins being connectable to the circuits on the board, and the second set of pins being adapted to extend in a given direction substantially parallel to the board, the protection means being separate from the connector body and attachable with the connector body, as a unit, to the board, said protection protective means comprising a mounting part and a protective part, said mounting part having means for engaging the mounting device affixed thereto and extending outwardly thereof, the connector body being adapted to be positioned between the board and the mounting part with said engaging means at least partially received in the recess in the connector body, said protective part adopted to extend beyond the edge of the connector body in a direction generally parallel to said given direction.

2. The pin protection means of claim 1, further comprising a second protection means comprising a mounting part with an opening through which the mounting device is adapted to extend, said mounting part of said second protection means being adapted to be situated between the connector body and the surface of the board and a protective part extending from said mounting part of said second protection means beyond the edge of the connector body in a direction generally parallel to said given direction.

3. The pin protection means of claim 2, wherein said mounting means of said second protection part comprises a plurality of openings adapted to align with the pins in said first set of pins.

4. In combination, an electrical connector of the type having a body with first and second adjacent sides, the first side being adapted to be mounted proximate the surface of a circuit board by a mounting device extending from the board through an opening in the body and into a recess in the body aligned with the opening, the recess being adapted to receive mounting device engaging means therein, the connector body having a first set of pins extending from said first side and a second set of pins extending from the second side, the first set of pins being connectable to the circuits on the board, and the second set of pins being adapted to extend in a given direction substantially parallel to the board, and pin protection means separate from the connector body and attachable with the connector body, as a unit, to the board, the protection means comprising a mounting part and a protective part, said mounting part having means for engaging the mounting device affixed thereto and extending outwardly thereof, said connector body being adapted to be positioned between the board and said mounting part with the engaging means at least partially received in the recess in the connector body, said protective part extending beyond the edge of the connector body in a direction generally parallel to said given direction.

5. The pin protection means of claim 4, further comprising a second protection means comprising a mounting part with an opening through which the mounting device is adapted to extend, said mounting part of said second protection means being adapted to be situated between the connector body and the surface of the board and a protective part extending from said mounting part of said second protection means beyond the edge of the connector body in a direction generally parallel to said given direction.

6. The pin protection means of claim 5, wherein said mounting part of said second protection means comprises a plurality of openings adapted to align with the pins in said first set of pins.

* * * * *